US005236553A

United States Patent [19]

Richter

[11] Patent Number: 5,236,553

[45] Date of Patent: Aug. 17, 1993

[54] CONTINUOUS COOKING WITH REDUCED HORSEPOWER AND PULP DEGRADATION

[75] Inventor: Johan C. F. C. Richter, Oslo, Norway

[73] Assignee: Kamyr AB, Karlstad, Sweden

[21] Appl. No.: 772,138

[22] Filed: Oct. 9, 1991

Related U.S. Application Data

[63] Continuation-in-part of Ser. No. 372,650, Jun. 28, 1989, abandoned.

[51] Int. Cl.[5] ..... D21C 1/00; D21C 7/00

[52] U.S. Cl. ..... 162/237; 162/239; 162/242; 162/246; 162/249; 162/251; 162/19; 162/39; 162/40

[58] Field of Search ..... 162/17, 19, 29, 39, 162/40, 52, 237, 239, 242, 246, 248, 249, 250, 251

[56] References Cited

U.S. PATENT DOCUMENTS

| | | | |
|---|---|---|---|
| 1,905,731 | 4/1933 | McKee | 162/249 |
| 1,933,017 | 10/1933 | Jansa et al. | 162/237 |
| 3,138,947 | 6/1964 | Johansen | 162/237 |
| 3,471,366 | 10/1969 | Reinhall | 162/19 |
| 3,802,956 | 4/1974 | Backlund | 162/237 |
| 3,902,962 | 9/1975 | Reinhall | 162/242 |
| 3,928,899 | 1/1967 | Laakso | 162/19 |
| 4,071,399 | 1/1978 | Prough | 162/19 |
| 4,093,511 | 6/1978 | Richter | 162/237 |

OTHER PUBLICATIONS

*The History of Kamyr Continuous Cooking*, by Johan Richter, 1981.

*Primary Examiner*—W. Gary Jones
*Assistant Examiner*—Todd J. Burns
*Attorney, Agent, or Firm*—Cushman, Darby & Cushman

[57] ABSTRACT

In the continuous cooking of comminuted cellulosic fibrous material (e.g. wood chips) to produce paper pulp, the material passes upwardly in an impregnation vessel which is within and concentric with a continuous digester and open at the top to digester pressure. At the top of the impregnation vessel, a solids/liquid separator (a screw within a screen cylinder) is provided. Separated liquid is returned in a conduit adjacent the exterior of the impregnation vessel, and open at the top to digester pressure, and passes out the bottom of the digester. The impregnation vessel is welded to the bottom of the digester, and the bottom of the digester is generally hemi-spherical, and substantially devoid of packings.

10 Claims, 2 Drawing Sheets

CONTINUOUS COOKING WITH REDUCED HORSEPOWER AND PULP DEGRADATION

This is a continuation-in-part of application Ser. No. 07/372,650, filed on Jun. 28, 1989 now abandoned.

BACKGROUND AND SUMMARY OF THE INVENTION

In co-pending application Ser. No. 07/200,204 filed May 31, 1988, apparatus and a method for continuously cooking pulp to enhance the quality of the pulp is disclosed. The apparatus and method therein provides for reduced mechanical handling of, and mechanical action on, the wood chips (or other comminuted cellulosic fibrous material that is utilized), and energy efficiency problems, quality drawbacks, and size limitations typically found in conventional cooking systems are minimized. According to the present invention, an alternative arrangement is provided which also has minimal mechanical action on the chips (especially where the temperature and pressure are high), and which should provide for reduced cost of operation, horsepower requirements, and pulp degradation. Also packings and seals that are common in conventional systems are unnecessary.

The internal impregnation vessel that is utilized in a number of the embodiments of said co-pending application Ser. No. 07/200,204 was under full digester pressure, and therefore the shell, flanges, nozzles, pipes, etc. had to be dimensioned accordingly. According to the present invention, however the actual internal impregnation vessel is also at digester pressure, however it comprises a non-pressurized tube since the pressure is the same on both sides of the vessel wall. Thus it is a mere standpipe, rather than a pressurized vessel (as in Ser. No. 07/200,204).

The impregnation vessel according to the invention passes the liquid slurry of fibrous cellulosic material upwardly to a solids/liquid separator located adjacent the top of the digester. Liquid that is separated is passed downwardly in a conduit welded or otherwise attached to the impregnation vessel, to ultimately pass out the bottom of the vessel. In this way, the minimum mechanical action on the chips achieved with said co-pending application apparatus and method is also substantially possible, while other advantages accrue.

According to one aspect of the present invention an apparatus for the continuous cooking of cellulosic fibrous material to produce paper pulp is provided. The apparatus comprises the following elements: (a) A generally vertically disposed impregnation vessel having a bottom, and a top in open communication with the digester pressure. (b) Means for feeding a liquid slurry of cellulosic fibrous material to the bottom of the impregnation vessel. (c) A mechanical separating means disposed at the top of the impregnation vessel for separating cellulosic fibrous material from liquid, so as to decrease the liquid to material ratio of the slurry. (d) A generally vertically disposed digesting vessel having a top and a bottom, and an inlet at the top thereof. (e) The top of the impregnation vessel located adjacent the top of the digesting vessel, and the impregnation vessel disposed within the digesting vessel, generally concentric therewith. (f) A liquid return conduit open to the digesting vessel pressure, and disposed within the digesting vessel adjacent the impregnation vessel, for returning liquid separated by means (c) to exit the bottom of the digesting vessel. (g) Extraction screen means disposed in the digesting vessel for withdrawing liquid therefrom. And, (h) pulp discharge means disposed adjacent the bottom of the digesting vessel.

According to another aspect of the present invention, a method of continuously digesting comminuted cellulosic fibrous material to produce paper pulp is provided. The method comprises the steps of substantially sequentially and continuously: (a) Feeding a liquid slurry of comminuted cellulosic fibrous material to the bottom of the impregnation vessel. (b) Flowing the material (at a temperature of about 100°-120° C.) upwardly in the impregnation vessel from the bottom to the top thereof, the impregnation vessel being open at the top to the digesting vessel pressure. (c) Separating some of the liquid from the slurry at the top of the impregnation vessel. (d) Moving the material from the bottom of the impregnation vessel to the top of the digesting vessel with a minimum of mechanical action on the material. (e) Withdrawing liquid separated in step (c) from the digesting vessel by passing it downwardly through the digesting vessel open to digesting vessel pressure out the bottom of the digesting vessel. (f) Digesting the material (at a temperature of about 160°-170° C.) in the digesting vessel, utilizing digesting liquid. And, (g) withdrawing pulp from the bottom of the digesting vessel.

It is the primary object of the present invention to provide for the enhanced continuous cooking of cellulosic fibrous material. This and other objects of the invention will become clear from an inspection of the detailed description of the invention and from the appended claims.

DETAILED DESCRIPTION OF THE DRAWINGS

Figures 1, 2:
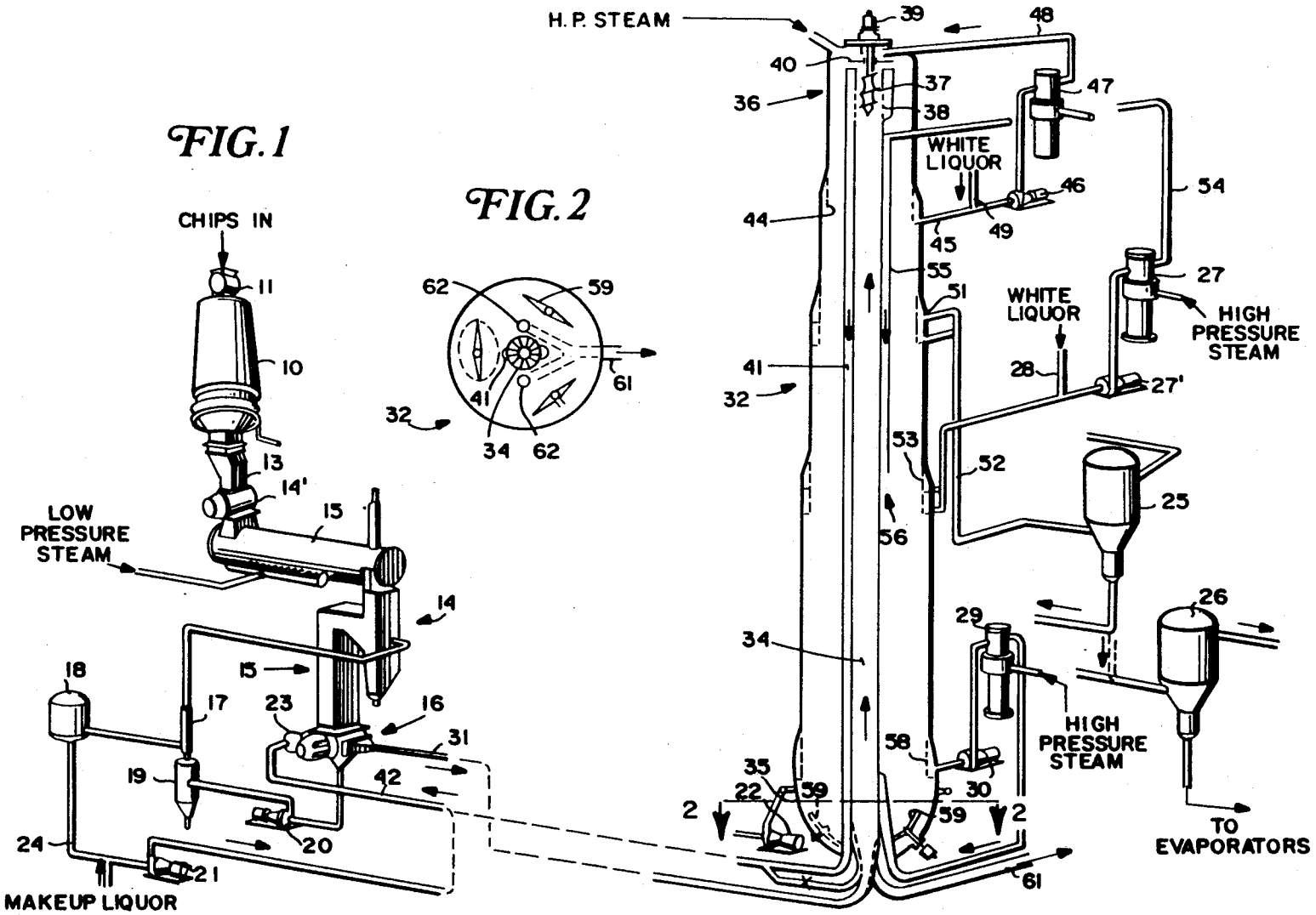
FIG. 1 is a schematic view of an exemplary apparatus according to the present invention for the continuous cooking of cellulosic fibrous material.
FIG. 2 is a schematic cross-sectional view, looking at the bottom of the vessel.
Figure 3:
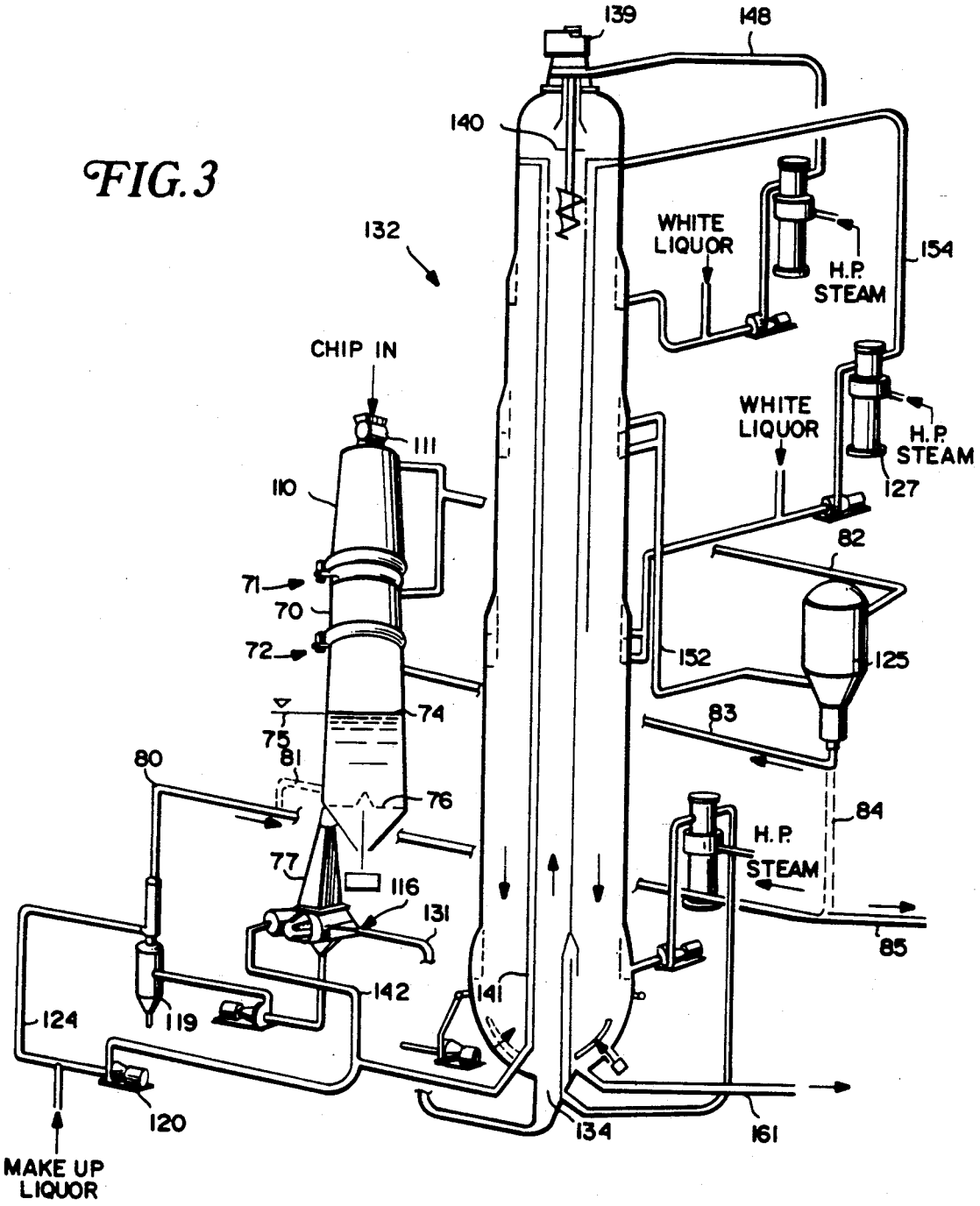
FIG. 3 is a schematic view of an alternative embodiment of apparatus according to the invention.

Most of the components of the apparatus illustrated in FIGS. 1-3 are conventional in continuous digester systems. For example in FIG. 1 a chips bin 10, preferably having an air lock 11 at the top thereof, has connections 12 for bin steaming by flash steam from flash tanks 25, 26, and leads to a chip meter 13, and low pressure feeder 14 into a chip chute 15 connected to the high pressure feeder 16. Those components are variously connected to an in-line drainer 17, a level tank 18, a sand separator 19, and various other pipes and components, such as pumps 20, 21, 22, and 23, and to the conduit 24 to which white liquor is added. Other conventional components include the flash tanks 25 and 26; heater 27 supplied with high pressure steam; pump 27'; white liquor input conduit 28; wash heater 29 supplied with high pressure steam; a pump 30; and a continuous vertical digester 32.

According to the present invention, for the embodiment illustrated in FIG. 1, a generally vertically disposed impregnation vessel 34 is provided having a bottom and a top in open connection with digester pressure. Means are provided including the conduit 31 connected to the high pressure feeder 16, and all the other conventional apparatus illustrated, for feeding a liquid slurry of comminuted cellulosic fibrous material (wood chips) to the bottom of the vessel 34.

The vessel 34 is non-pressurized. It is held in place by welding it to the interior of the bottom of the digester 32 and is guided with gussets and/or tubes (not shown) at the top. The bottom 35 of the digester 32 preferably is generally hemi-spherical. This reduces necessary plate thickness, and also reduces deformation. It is also substantially devoid of packings compared to the prior art. Only short length packings are provided, and they preferably are of the male/female type rather than glands.

At the top of the tube 34, which is interior of the digester 32 and substantially concentric with it, a conventional solids/liquid separator 36 is provided. The separator 36 is of the same type as normally provided at the top of a digester, although its exact positioning and surrounding components are slightly different. The separator 36 preferably comprises an internal helical screw 37 surrounded by a screen cylinder 38, and rotated by a motor 39. A scraper 40 also rotates with the screw 39 to discharge slurried chips flowing out of the top of the tube 34 into the surrounding annular interior (inlet) of the digester 32. High pressure steam may be added at the top of digester 32.

The liquid that is separated by the separator 36 is withdrawn from the digester 32 by the non-pressurized conduit 41. The conduit 41 is welded or otherwise attached to the tube 34, and carries the separated liquid through the entire height of the digester 32, to be discharged through the bottom 35, and to pass in line 42 to the high pressure pump 23 associated with the high pressure feeder 16. The line 42 may be connected to a stationary screen (not shown) at the bottom of the tube 34 for pre-extraction, to facilitate any slight adjustments that are desired.

The digester 32 contains conventional screens 44 adjacent the top thereof, with a withdrawal conduit 45 leading to a pump 46 and an indirect heater 47. The recirculated liquid withdrawn through screens 44 passes through conduit 48 and immediately contacts the chips as they are discharged out of the top of the tube 34 and distributed by the rotating scraper 40. Make-up white liquor is added in line 49.

Further down in the digester 32 withdrawal screens 51 are provided, which cooperate with a conduit 52 leading to a flash tank 25, and typically also to a flash tank 26. Alternatively, the removed black liquor may be utilized for high sulfidity cooking, as described in copending application Ser. No. 07/372,624 filed Jun. 28, 1989 now U.S. Pat. No. 5,053,108 entitled "High Sulfidity Cook for Paper Pulp Using Black Liquor for Sulfonization of Steamed Chips".

Still further down in the digester 32 are annular withdrawal screens 53 which cooperate with the pump 27' earlier described. The heated withdrawn liquor is returned via conduit 54 to the internal conduit 55. The conduit 55, rather than being "hung" in the digester as in conventional in continuous digesters, is welded or otherwise attached to the exterior of the tube 34, and liquid therefrom is discharged back into the chips column at 56, which is preferably at least a semi-annular header. A plurality of such interior conduits 55 may be provided for returning recirculated liquid.

Adjacent the bottom of the digester 32 are wash withdrawal screens, cooperating with the heater 29 and pump 30 earlier described. To facilitate discharge of the paper pulp from the bottom of the digesting vessel 32, rotating mini-scrapers 59 preferably are provided, which assist in forcing the pulp into the outlet 61, forked to a nozzle 62 (see FIG. 2) on either side of tube 34.

The FIG. 3 embodiment is similar to the FIG. 1 embodiment, and like components are shown by like reference numerals only preceded by a "1". Only the components which are significantly different will be described with respect to the FIG. 2 embodiment.

In the FIG. 3 embodiment, a lower chips bin 70 is provided below the chips bin 110, with vibrator 71, 72 for the bins 110, 70, respectively. The bin 72 is connected to a vertical vessel 74 having steam at the top thereof, and establishing a liquid level 75. The comminuted cellulosic fibrous material (e.g. wood chips) is slurried in the vessel 74. It is discharged from the vessel 74 utilizing the rotating bottom scraper 76 into the conduit 77 attached to the high pressure feeder 116.

The lines 80, 81, 82, and 83 provide for the supply of steam and/or black liquor to the vessel 74. Steam from flash tank 125 passes through conduit 82 to the chips bin 110, and separated black liquor passes in conduit 83 to the vessel 74 to provide part of the slurrying liquid. The slurrying liquid is withdrawn, to a large extent, at the high pressure feeder 116, passing through sand separator 119 to line 80 which returns the black liquor to evaporators and/or recovery. Some of the black liquor may be diverted from line 80, via line 81, to the vessel 74 to provide additional slurrying liquid where necessary. The conduit 84 may be provided to cause black liquor separated at the flash tank 125 to pass straight to the line 85 extending to the evaporators/recovery area, rather than being used as slurrying liquid.

The digester 32, 132 may either be a hydraulic digester or a steam phase digester. A steam phase digester 32 is shown in FIG. 1, and a hydraulic digester 132 in FIG. 3.

Utilizing either the apparatus of FIG. 1 or FIG. 3, a method of continuously digesting comminuted cellulosic fibrous material to produce paper pulp is provided, which method will be described with respect to FIG. 1. A liquid slurry from chute 15 of comminuted cellulosic fibrous material is fed via line 31 in high pressure feeder 16 to the bottom of the impregnation vessel 34. The material is caused to flow upwardly in the vessel 34 from the bottom to the top thereof. A surplus of liquid in the slurry floats the fibrous material to the top of the vessel 34, whereupon, the surplus floatation liquid is separated from the slurry at the top of the tube 34 by the separator 36. The material is moved from the bottom of the vessel 34 to the top of the digester 32 with a minimum of mechanical action on the material, with the vessel 34 open at the top to the digesting vessel 32 pressure. Liquid separated by the separator 36 is withdrawn from the digesting vessel 32 by passing it downwardly through the vessel 32 in conduit 41, open to digester pressure at the top of conduit 41, out the bottom of the digester 32, to return conduit 42 to the high pressure feeder pump 23. The chips are digested in the digester 32 utilizing digesting liquid (white liquor), and the produced pulp is withdrawn through conduit 61 at the bottom of the vessel 32. The digesting liquor is provided at least in part through conduit 55, attached to the tube 34, and entering the chips column at point 56.

During impregnation in vessel 34, the temperature of the material is maintained at between about 100°-120° C. During digesting in vessel 32, the temperature is maintained between about 160°-170° C.

The produced pulp will have less degradation than conventionally, and is produced at less cost and horsepower.

It will thus be seen that according to the present invention a method and apparatus are provided for the effective continuous cooking of cellulosic fibrous material. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent methods and devices.

What is claimed is:

1. Apparatus for continuous cooking of cellulosic fibrous material to produce paper pulp, comprising:

(a) a generally vertically disposed impregnation vessel having a top and a bottom;

(b) means for feeding a liquid slurry of cellulosic fibrous material to the bottom of the impregnation vessel and for floating the cellulosic fibrous material to the top of the impregnation vessel with a surplus of liquid in the slurry;

(c) a mechanical separating means disposed at the top of the impregnation vessel for separating cellulosic fibrous material from the surplus floatation liquid, so as to decrease the liquid to material ratio of the slurry;

(d) a generally vertically disposed digesting vessel having a top and a bottom, and an inlet at the top thereof;

(e) the top of the impregnation vessel located adjacent the top of the digesting vessel with the top of the digesting vessel located to receive cellulosic fibrous material separated by said mechanical separating means at the top of said impregnation vessel, with the top of the impregnation vessel in open connection to the digesting vessel pressure, and the impregnation vessel disposed within the digesting vessel, generally concentric therewith so that the pressure in said impregnation vessel will be substantially the same as the pressure in said digesting vessel;

(f) a liquid return conduit open to the digesting vessel pressure, and disposed within the digesting vessel adjacent said impregnation vessel, for returning liquid separated by means (c) to exit the bottom of said digesting vessel;

(g) extraction screen means disposed in the digesting vessel for withdrawing liquid therefrom; and (h) pulp discharge means disposed adjacent the bottom of the digesting vessel.

2. Apparatus as recited in claim 1 further comprising conduit means disposed on the exterior of the impregnation vessel for distributing treatment liquid into the column of material in the digesting vessel at at least one level within the digesting vessel.

3. Apparatus as recited in claim 2 wherein the impregnation vessel is substantially circular in cross-section, and said conduit means comprises a plurality of distinct conduits on the exterior of the impregnation vessel, each conduit extending from adjacent the top of the impregnation vessel to a different height along the length of the impregnation vessel.

4. Apparatus as recited in claim 3 wherein said vessel (a) is welded at the bottom to the interior of the vessel (d).

5. Apparatus as recited in claim 4 wherein the bottom of vessel (d) is generally hemi-spherical, and devoid of packings.

6. Apparatus as recited in claim 1 wherein said vessel (a) is welded at the bottom to the interior of the vessel (d).

7. Apparatus as recited in claim 1 wherein the bottom of vessel (d) is generally hemi-spherical, and devoid of packings.

8. Apparatus as recited in claim 1 wherein said means (c) comprises a feeder screw rotating about a vertical axis disposed within a perforated tubular separating shell having perforations therein large enough to allow liquid flow therethrough, but small enough to prevent most material flow therethrough.

9. Apparatus as recited in claim 1 wherein the digesting vessel comprises a steam phase digester.

10. Apparatus as recited in claim 1 wherein the digesting vessel comprises a hydraulic digester.

* * * * *